US005456435A

United States Patent [19]

Sweeney

[11] Patent Number: 5,456,435

[45] Date of Patent: Oct. 10, 1995

[54] SHELF BRACKET APPARATUS

[75] Inventor: Jim Sweeney, Belvidere, N.J.

[73] Assignee: HMG Worldwide In-Store Marketing, Inc., New York, N.Y.

[21] Appl. No.: 72,480

[22] Filed: Jun. 4, 1993

[51] Int. Cl.[6] ..... A47G 29/02

[52] U.S. Cl. ..... 248/250; 211/90; 248/243

[58] Field of Search ..... 248/244, 235, 248/245, 250, 241, 243, 222.1; 211/90, 192, 193, 134, 153; 108/152, 27, 28; 312/126

[56] References Cited

U.S. PATENT DOCUMENTS

| | | | |
|---|---|---|---|
| 3,054,511 | 9/1962 | Erismann | 248/243 |
| 3,102,499 | 9/9163 | Shelor | 108/28 |
| 3,193,108 | 7/1965 | Johnson | 211/153 |
| 3,249,233 | 5/1966 | Marcus et al. | 211/105.3 |
| 3,485,382 | 12/1969 | Larson | 211/153 X |
| 3,964,712 | 6/1976 | Staudte, Jr. . | |
| 4,010,697 | 3/1977 | Einhorn . | |
| 4,042,097 | 8/1977 | Clark et al. | 248/243 X |
| 4,093,168 | 6/1978 | Buril . | |
| 4,155,459 | 5/1979 | Marschak . | |
| 4,429,850 | 2/1984 | Weber et al. | 248/250 |
| 4,614,273 | 9/1986 | Ishii | 248/245 X |
| 4,671,481 | 6/1987 | Beard . | |
| 4,688,683 | 8/1987 | Thalenfeld . | |
| 4,736,919 | 4/1988 | Bessinger . | |

*Primary Examiner*—Ramon O. Ramirez
*Assistant Examiner*—Korie H. Chan
*Attorney, Agent, or Firm*—Cohen, Pontani, Lieberman, Pavane

[57] ABSTRACT

A cooperating shelf and bracket system having a bracket which embraces and engages the rear portion of the shelf so as to support the shelf and permit its mounting in cantilever fashion from a shelf upright. The bracket may be formed with arms which grip cooperating structure on the shelf so that when fully inserted the shelf is securely retained in the bracket. The shelf is easily removable via a releasing system, which permits the shelf to be inserted and removed in a horizontal plane without the need for rotation relative to the bracket.

10 Claims, 4 Drawing Sheets

SHELF BRACKET APPARATUS

The present invention relates to a new and improved mounting bracket for shelves and has particular utility in shelf systems having a plurality of shelf layers which would prevent the removal of a shelf through a rotational movement.

BACKGROUND OF THE INVENTION

Especially in the merchandising arts, products are arrayed for presentation to the consuming public on shelf systems having a array of shelf elements each supported by an appropriate mounting system. Because the size and nature of products displayed is capable of wide variation, it is necessary that the shelves be able to be repositioned to accommodate such variation. In addition, variations in the size, configuration and layout of the shelves themselves often necessitate the ability to remove a given shelf element from the array, either for restocking of product, or for replacement by another shelf.

Conventional shelf systems typically utilize as a mounting system a set of uprights or hangers upon which the shelf supporting brackets may be affixed. Affixation and removal normally requires the shelf bracket to be pivoted upwardly to engage the bracket from the upright or hanger. When the shelf contains product, or is in close vertical proximity to another shelf, such manipulation is cumbersome, if not impossible without disassembly of a substantial portion of the shelf system.

It is accordingly a purpose of the present invention to provide a shelf bracket which may be utilized in conjunction with conventional shelf systems, and which allows shelf insertion and removal without the necessity for pivoting the shelf.

Another purpose of the present invention is to provide a shelf bracket apparatus which provides for positive engagement with the shelf, and which can be easily released when required.

Still another purpose of the present invention is to provide a shelf bracket which has minimal intrusion into the space between the shelves, and which provides an uncluttered appearance to at least the forward, exposed shelf surface.

Yet another purpose of the present invention is to provide a shelf mounting bracket which is of simple and rugged construction, and which may be manufactured easily and conveniently.

BRIEF DESCRIPTION OF THE INVENTION

The foregoing and other purposes and objects are embodied in the present invention which comprises a shelf bracket system which embraces and engages the rear portion of a shelf to support the shelf and permit its mounting in a cantilever fashion from a shelf upright. The bracket may be formed with pairs of arms which define a cavity or space therebetween, and into which an edge of the shelf to be mounted is inserted. Locking means on the bracket engage with coacting means on the shelf to secure the shelf in the fully inserted position. A release system is provided to permit the shelf to be disengaged from the bracket. Both insertion and removal of the shelf from the bracket occur in a horizontal plane, without the necessity for rotation of the shelf with respect to the bracket.

In a preferred embodiment, the locking means comprise a hook assembly which engages with a groove located on a shelf surface proximate the shelf rear edge. A cam allows for disengagement between the bracket and groove when shelf release is desired. The rear wall of the bracket may be provided with connectors which allow the bracket to be affixed to a variety of adaptor plates, which in turn are mountable to different shelf upright structures.

BRIEF DESCRIPTION OF THE DRAWINGS

A fuller understanding of the present invention will be accomplished upon consideration of the following detailed description of preferred, but nonetheless illustrative, embodiments of the invention when reviewed in association with the annexed drawings, wherein.

DETAILED DESCRIPTION OF THE INVENTION

Figure 1:
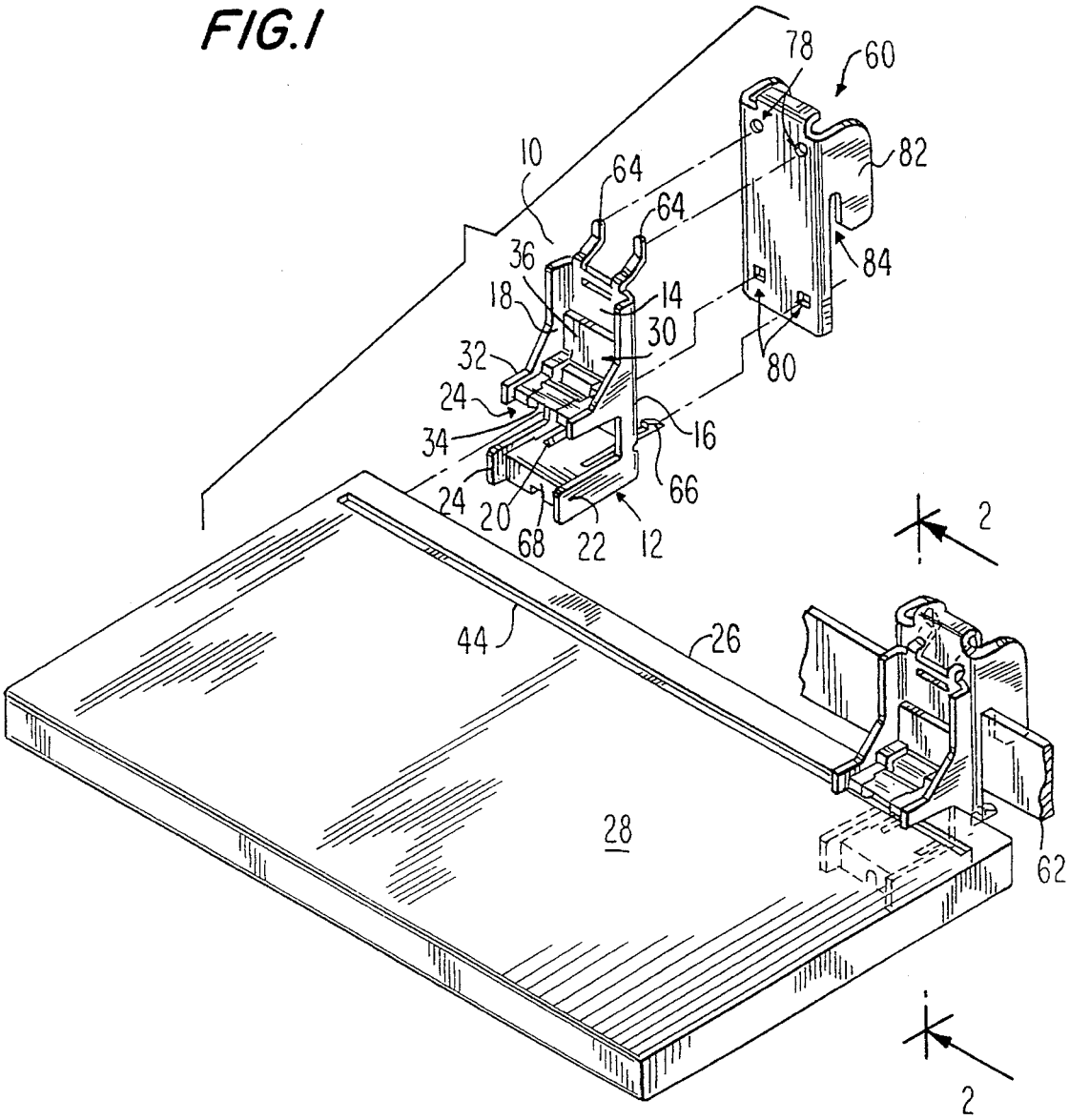
FIG. 1 is a perspective view of the present invention depicting a first bracket engaged with a shelf and an upright and a second bracket and adaptor displaced from the shelf.
Figure 2:
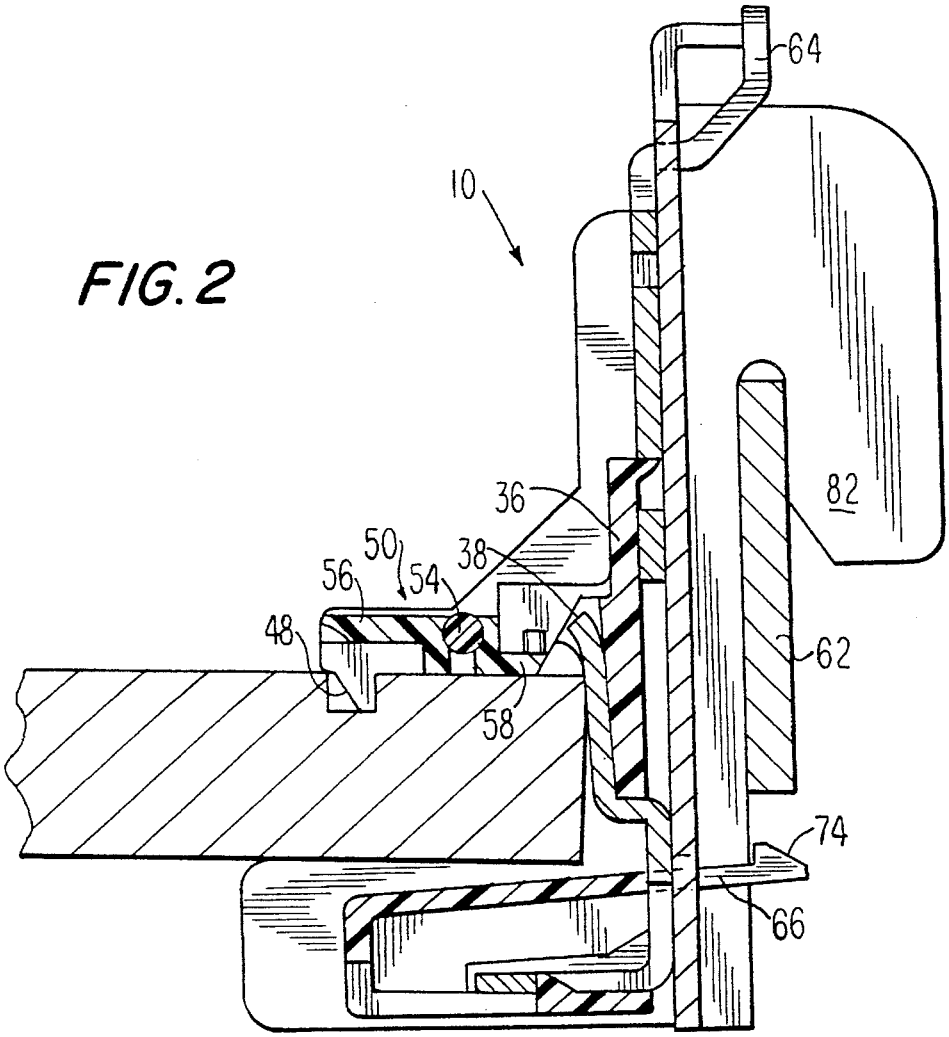
FIG. 2 is a side elevation view in section taken along line 2—2 of FIG. 1.
Figure 6:
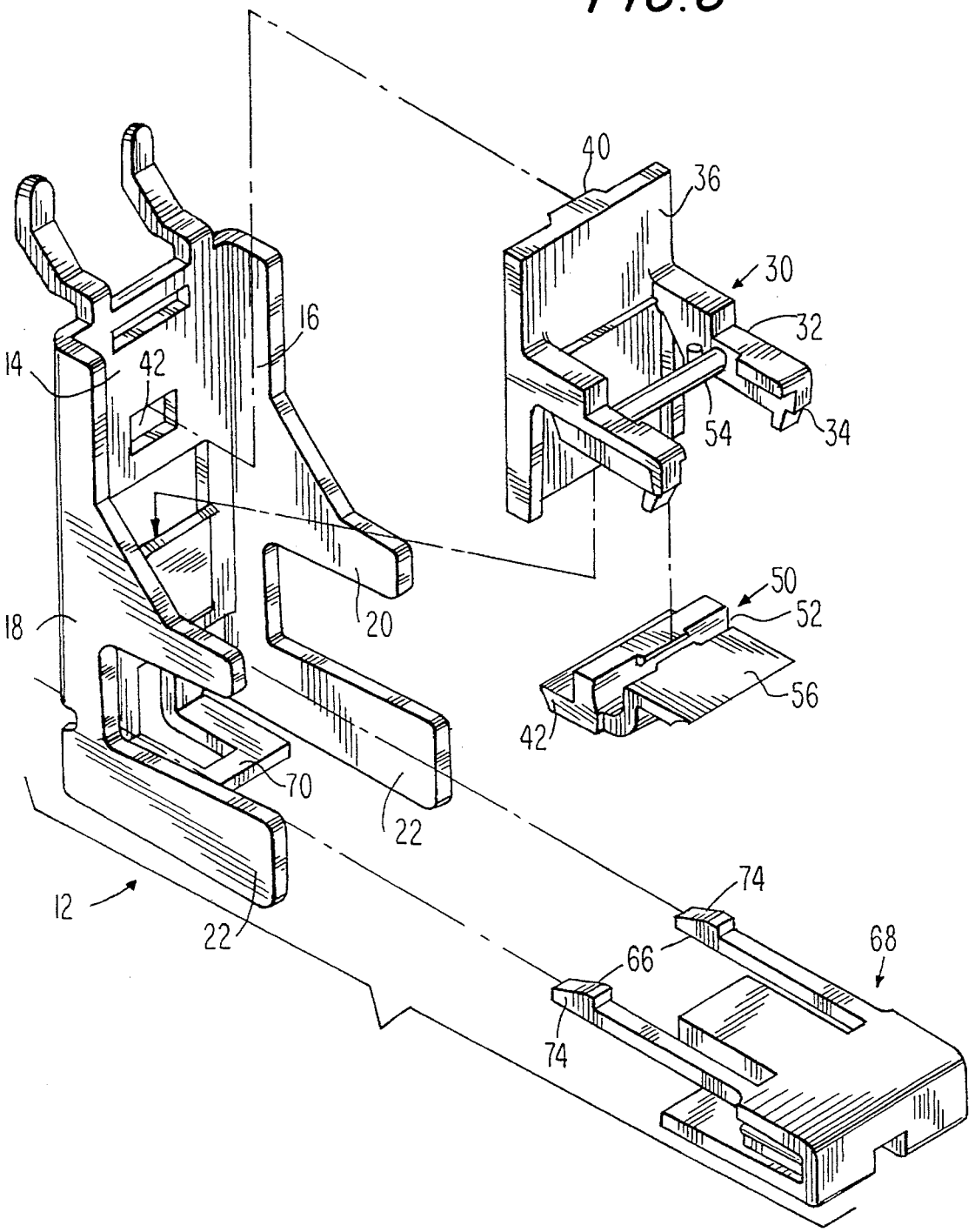
FIG. 6 is an exploded perspective view of the constituent parts of the bracket.

Referring initially to FIGS. 1, 2, and 6, bracket assembly 10 comprises a frame 12, formed of steel, aluminum or the like, having a rear wall 14 and two forwardly-extending parallel side walls 16 and 18. Each side wall is formed into upper and lower arms 20, 22, respectively, defining a pair of slots 24 therebetween dimensioned to accept the rear edge 26 and adjoining portion of shelf 28. When so inserted, the shelf extends outwardly from the bracket assembly 10 in a cantilever manner.

In order to retain the shelf in the bracket, locking means are provided. As detailed in FIGS. 2, 3, and 6, mounted to the rear wall 14 is hook arm assembly 30, comprising a pair of hook arms 32 each having a depending hook portion 34 at its distal end. The hook arms extend forwardly from a base plate 36. The base plate 36 is mounted to the front surface of bracket rear wall 14 between the side walls 14, 16 by a clamp 38 formed in the rear wall. A rearwardly-extending tab 40 on the base plate locks into a mating rectangular aperture 42 on the rear wall. The hook arms and hooks are positioned so as to engage with a depression or notch located on the top surface of the shelf to be inserted into the slots 24 formed by the bracket arms. As shown in FIG. 1, the notch may be in the form of a longitudinally-extending slot 44, positioned with respect to the shelf rear edge 46 to be engaged by the hooks when the shelf is fully inserted into the reception slots. The hooks each may be provided with an angular, forwardly-directed cam surface 48 to permit an upwardly-directed force to be generated at the point of contact with the shelf as the shelf is inserted. As the hook arms are formed from a resilient material such as an appropriate plastic composition, the hook arms flex slightly, permitting insertion of the shelf, followed by interlocking between the hooks and the shelf slot 44.

The locking mechanism formed between the bracket hooks and shelf slot insures that the shelf 24 cannot be inadvertently removed from the bracket. To allow shelf removal when desired, however, the bracket unit 10 includes a cam mechanism 50. As may be seen, cam arm 52 is pivotally mounted between the hook arms 32 on axle 54 extending therebetween. The forward portion 56 of the cam arm serves as an actuating handle or arm, and when lifted as shown by the arrow in FIG. 3, causes the rearward cam portion 42 to rotate downwardly into contact with the top surface of the inserted shelf 24. Because the axle is mounted to the hook arms, the upward force on the actuating cam arm portion 56 allows the hook arms to flex upwardly about the line of contact between the rearward portion of the cam arm and the shelf, lifting the hooks 34 out of engagement with the shelf slot 44. While the hooks are maintained in the raised position, the shelf 24 may be pulled forward, out of engagement with the bracket. The shelf is thus removable for restocking, replacement or other desired activities.

To allow the bracket to be mounted to a shelf support system, the bracket near wall 14 may be provided with appropriate mounting means. To provide increased flexibility of mounting, and to allow the bracket to be used with a variety of support system configurations, adaptor plates may be used between the bracket and support element.

Figure 3:
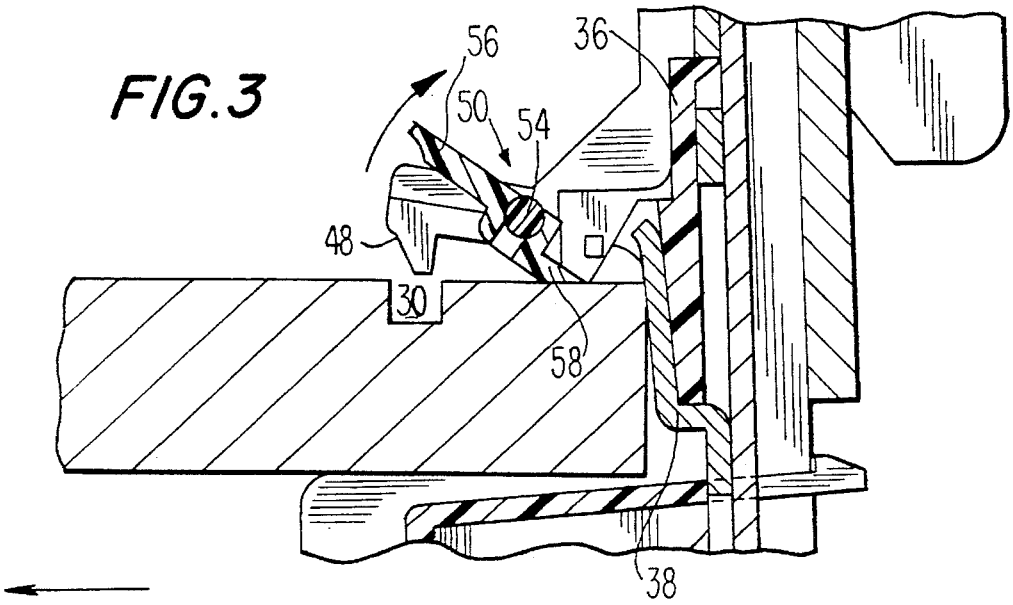
FIG. 3 is a side elevation view taken along line 2—2 depicting disengagement between the shelf and bracket.

As presented in FIGS. 1 through 3, a metal or other rigid material adaptor plate 60 may be used to allow mounting of the bracket assembly 10 to a shelf support structure having a plurality of horizontally-extending beams or bars, as exemplified by the element 62. In order to engage the adaptor plate the bracket includes a pair of rearwardly and upwardly-projecting mounting pins 64, extending from the upper edge of rear wall 14. In addition, a pair of flexible lower mounting hooks 66, are preferably formed as projections on an insert 68 which is mounted between the lower arms 22 on a projection 70 extending between the arms from rear wall 14. (See FIG. 6). The insert embraces the projection and is maintained in position by a key (not shown) which engages the cutout 72 in the projection. The mounting hooks, which are provided with locking flanges 74 at their distal ends, project through apertures in the bracket rear wall 14. By constructing the insert and hooks out of a plastic material, sufficient resiliency can be obtained to permit a snap action fit between the bracket assembly and adaptor plate to be achieved.

As illustrated in FIG. 1, the adaptor plate includes a front plate 76 against which the bracket assembly lies, apertures 78, 78 and 80, 80 being dimensioned and located to accept the mounting pins 64 and the mounting hooks 66, respectively. It is to be appreciated that the bracket assembly is mounted to the adaptor prior to insertion of the shelf 24, the pins 64 being inserted first, followed by a pivoting motion of the bracket assembly with respect to the adaptor to allow the hooks 66 to pass through the lower aperture 62 and lock the elements together. A pair of rearwardly-extending mounting ears 82 on the adaptor plate define a pair of vertical slots 84, dimensioned as seen in FIGS. 2 and 3, to allow the adaptor plate and thus the mounted bracket assembly 10 to be hung on the transverse bar 62. Such a construction permits the bracket assembly to be positioned as desired along a given bar.

Figure 4:
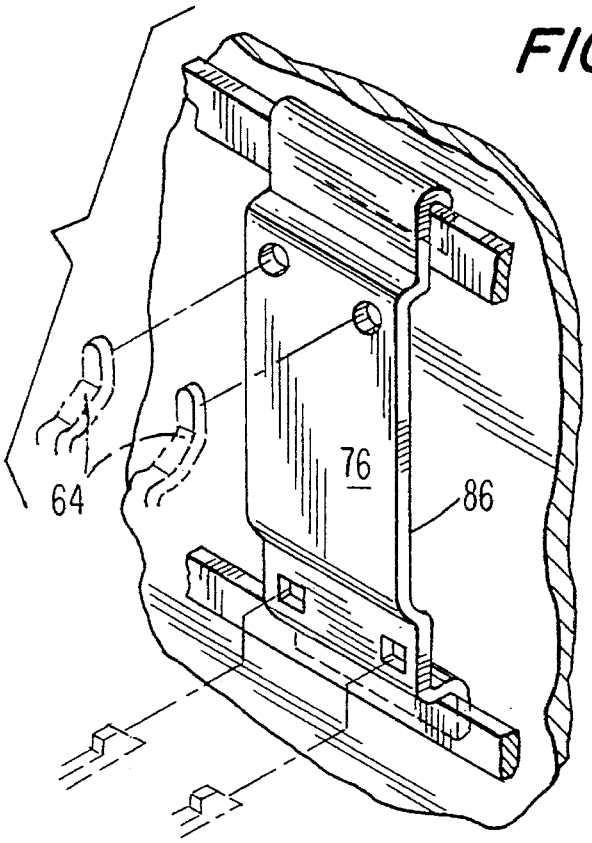
FIG. 4 is a perspective view of a second adaptor.
Figure 5:
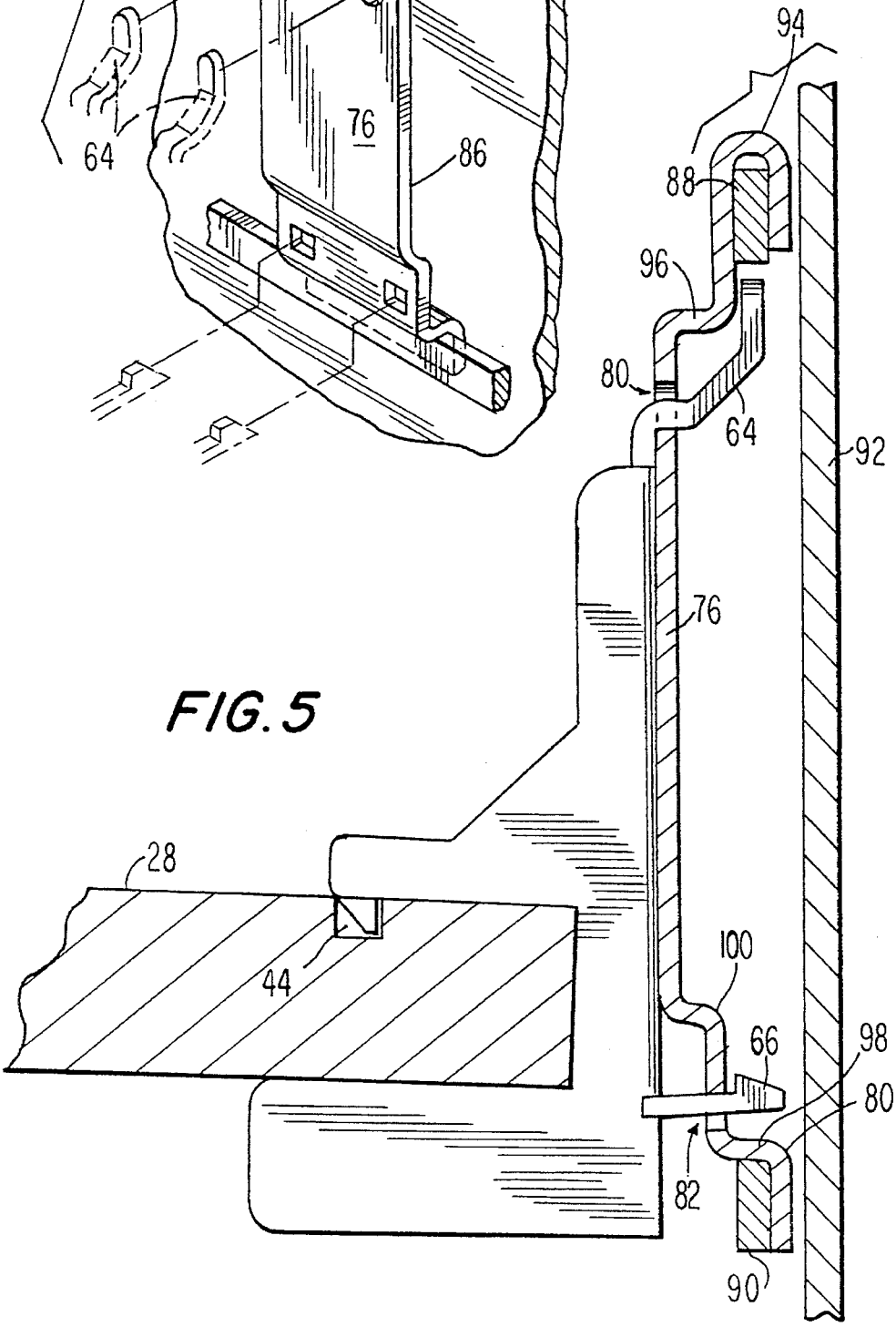
FIG. 5 is a side elevation view of the invention depicting the bracket and support mounted to the adaptor of FIG. 4.

As shown in FIGS. 4 and 5, a second form of adaptor 86, formed of steel or the like, may be utilized to allow mounting of the bracket assembly 10 on a shelf standard structure having spaced, transverse rungs as depicted by the rungs 88, 90. As depicted in those Figures, the adaptor 86 again includes plate 76 against which the bracket assembly rests, with the apertures 80 for acceptance of the bracket mounting pins 64. As the mounting rungs typically have limited clearance between their rearwardly-facing surfaces and a shelf system partition or wall 92, the plate 76 is displaced forwardly from the inverted U-shaped mounting flange portion 94 of the adaptor by an intermediate portion 96. Formed ledge portion 98, adapted to engage and rest upon a second rung 90, is similarly displaced rearwardly from the mounting surface 50 by a second lower intermediate section 100, which is provided with the second apertures 82 for the hooks 66.

Typically, multiple brackets 10 used to support a shelf after positioning the brackets as required on the shelf support system, either alone or in conjunction with an adaptor, the shelf may be inserted into the brackets and is locked in place. When removal of the shelf is required, the cam is manually operated to disengage the locking assembly, allowing the shelf to be removed by a horizontal withdrawing action. Adjacent shelves need not be disturbed by either insertion or removal.

It is to be recognized by those skilled in the art that variation and modification of the invention as set forth herein may be accomplished without departing from the true scope of the invention.

I claim:

1. Apparatus for the cantilever mounting of a shelf to a vertical surface, comprising a frame having a rear wall adapted to be mounted to the vertical surface and first and second side walls projecting outwardly from said rear wall, said side walls defining a pair of openings for acceptance of an edge of said shelf; hook means mounted to said frame for engagement with said shelf upon insertion of said shelf within said openings to maintain said shelf therein; and means for releasing said hook means to permit the removal of said shelf from said frame.

2. The apparatus of claim 1, wherein said release means comprise a cam member engageable with said shelf for separating said hook means from said shelf.

3. The apparatus of claim 2, wherein said hook means comprise a plate mounted to said frame having a pair of hook arms each terminating in a hook prong, said cam member being pivotally mounted to said hook arms.

4. The apparatus of claim 3, wherein said hook means plate is mounted to said frame rear wall, said hook arms being located between said side walls.

5. The apparatus of claim 4, further comprising an axle extending between said hook arms for pivotally mounting said cam member.

6. The apparatus of claim 3, wherein said hook arms are formed of a resilient material to permit said hook arms to be temporarily disengaged from contact with said shelf by a force exerted upon said hook element by said cam.

7. The apparatus of claim 3 wherein a surface of said shelf defines a groove and wherein said hook means are adapted to engage said groove.

8. The apparatus of claim 1, further comprising at least one pair of mounting prongs projecting rearwardly from said rear wall.

9. The apparatus of claim 8 further comprising an adaptor plate having apertures positioned to be engaged by said at least one pair of prongs, said adaptor plate having means for mounting said plate to a shelf support system.

10. The apparatus of claim 8, wherein said rear wall defines a forwardly extending projection, said projection extending between said sidewalls, and wherein said prongs are formed from a unitary resilient element mounted to said projection.

* * * * *